US005949199A

United States Patent [19]

Qian et al.

[11] Patent Number: 5,949,199

[45] Date of Patent: Sep. 7, 1999

[54] GAS DISCHARGE LAMP INVERTER WITH A WIDE INPUT VOLTAGE RANGE

[75] Inventors: Jinrong Qian, Croton-on-Hudson, N.Y.; Fred C. Lee, Blacksburg, Va.

[73] Assignee: Virginia Tech Intellectual Properties, Blacksburg, Va.

[21] Appl. No.: 09/063,440

[22] Filed: Apr. 21, 1998

Related U.S. Application Data

[60] Provisional application No. 60/059,776, Sep. 23, 1997.

[51] Int. Cl.[6] ..... H05B 37/00

[52] U.S. Cl. ..... 315/307; 315/224; 315/DIG. 5

[58] Field of Search ..... 315/307, 209 R, 315/219, 291, 224, 200 R, DIG. 2, DIG. 5

[56] References Cited

U.S. PATENT DOCUMENTS

| | | | |
|---|---|---|---|
| 4,511,823 | 4/1985 | Eaton et al. | 315/226 |
| 5,274,540 | 12/1993 | Maehara | 363/37 |
| 5,404,082 | 4/1995 | Hernandez et al. | 315/219 |
| 5,410,221 | 4/1995 | Mattas et al. | 315/307 |
| 5,410,466 | 4/1995 | Maehara | 363/98 |
| 5,521,467 | 5/1996 | Statnic et al. | 315/247 |
| 5,801,492 | 9/1998 | Bobel | 315/244 |

*Primary Examiner*—Don Wong
*Assistant Examiner*—David H. Vu
*Attorney, Agent, or Firm*—Nikaido, Marmelstein, Murray & Oram LLP

[57] ABSTRACT

A gas discharge lamp driving circuit reduces input power at start-up mode through the utilization of input power diodes and stress capacitors in parallel therewith. The circuit includes a blocking filter for filtering an AC voltage signal, and a rectifier for rectifying the signal into a DC voltage. A smoothing capacitor smooths the voltage, and an inverter, having switches, converts the DC voltage into a high frequency AC voltage. A control circuit controls the switches of the inverter to turn on and off in a feedback manner. A resonant tank is connected to the inverter, and includes a resonant capacitor and a resonant inductor. A discharge lamp is connected to the resonant tank, in parallel with the resonant capacitor. A modulation capacitor is provided for reducing a distortion of the input current to the resonant circuit. The at least two input power diodes and the stress capacitors are connected between the rectifier and the smoothing capacitor, such that a discharge time of the stress capacitors delays a turn-on time of the input power diodes, to reduce input power at start-up.

9 Claims, 15 Drawing Sheets

GAS DISCHARGE LAMP INVERTER WITH A WIDE INPUT VOLTAGE RANGE

This application claims the benefit of U.S. Provisional Application No. 60/059,776, filed Sep. 23, 1997.

BACKGROUND OF THE INVENTION

1. Field of the Invention

An electronic ballast converts a low frequency AC current as input to a high frequency current to the gas discharge lamp so that the lamp operates efficiently. Such ballast or converter is required to have low line input current harmonics as well as a high power factor in order to satisfy the stringent requirement regarding operating parameters. Many configurations have been proposed to achieve low input current distortion. Among them, so-called boost converter is a typical power factor correction converter. A boost converter, followed by a DC/AC inverter is able to provide a high frequency current fed to the lamp with power factor correction and low input current harmonics. However, the energy is processed in two separate conversion stages. As a result, the component count increases, which in turn causes the converter to be bulky and causes an increase in cost. In order to reduce costs, many integrated power factor correction stages with DC/AC inverters have been proposed.

2. Description of the Related Art

U.S. Pat. No. 5,274,540, hereby incorporated by reference, discloses a circuit shown in FIG. 1. Capacitor Cin is used to achieve power factor correction. Capacitor Cin integrates a power factor correction converter with a DC/AC inverter, composed of a half-bridge switches S1 and S2, and a series resonant tank of inductor Lr and capacitor Cr so that the component count is reduced, thereby reducing costs. The equivalent circuit of FIG. 1 is shown in FIG. 2, where the lamp voltage is considered as a high frequency voltage source. Charge capacitor Cin is in series with a high frequency voltage to charge capacitor Cin through the line input and to discharge the capacitor energy to bulk capacitor $C_B$ so that power factor correction can be achieved. There are four mode operations over one switching cycle. The switching waveforms are shown in FIG. 3.

Mode 1 [$t_0$, $t_1$]: Before time $t_0$, voltage $v_m$ is clamped to voltage $V_{dc}$, and diode Dy is on. After time $t_0$, voltage $v_a$ decreases with a sinusoidal waveform. Since the charge capacitor voltage $v_c$ can not change abruptly, diode Dy is in reverse bias, and voltage $v_m$ also decreases with the same form. Voltage $v_m$ at this time is still higher than the rectified line voltage, diode Dx is reverse biased, voltage $v_c$ keeps constant because there is no current through capacitor Cin and both diodes Dx and Dy are off. This mode ends at time $t_1$, where the voltage $v_m$ is equal to the rectified line voltage. Diode Dx becomes forward-biased, and begins to conduct.

Mode 2 [$t_1$, $t_2$]: At time $t_1$, diode Dx is turned on, and voltage $v_m$ is clamped to the rectified line voltage. Since voltage $v_a$ continues to decrease, the charge capacitor voltage $v_c$ increases to $V_a+|v_{in}|$ at time $t_2$. During this time interval, the charge capacitor absorbs energy from the line input. Its voltage and charging current are determined by:

$$v = |v_{in}| - V_a\cos\omega_s(t-t_0) \qquad (1)$$
$$i_c = CinV_a - v_a\omega_a\cos\omega_s(t-t_0) \quad t_1 < t < t_2$$

where ωs and Va are the frequency and the peak voltage of the voltage source $v_a$, respectively. At time $t_2$, current $i_x$ becomes zero, and diode $D_x$ is naturally turned off. The maximum charge capacitor voltage $V_{c,\,max}$ is $$V_c,\ max = V_a + |V_{in}|. \qquad (2)$$

Mode 3 [$t_2$, $t_3$]: At time $t_2$, diode Dx is turned off. Because voltage $v_m$ is lower than the DC bus voltage, diode Dy is in the reverse bias. No current flows through the charge capacitor Cin and voltage $v_c$ keeps constant. On the other hand, voltage $v_m$ continuously increases with the increase of voltage $v_a$ until time $t_3$, where voltage $v_m$ reaches the DC bus voltage, and diode Dy is turned on.

Mode 4 [$t_3$, $t_4$]: At time $t_3$, voltage $v_m$ is clamped to the DC bus voltage, and diode Dy is turned on. Charge capacitor Cin discharges, and its energy is pumped to capacitor $C_B$ due to the continuous increase of voltage $v_a$. The charge capacitor voltage and its charging current are $$v_c = V_{dc} - V_2\cos\omega_s(t-t_0) \qquad (3)$$
$$i_c = CinV_{dc}\omega_s\sin\omega_s(t-t_0) \quad t_3 < t < t_4$$

Voltage vc reaches its minimum value at time $t_4$, which is given by $$V_{c,min} = V_{dc} - V_a. \qquad (4)$$

At time $t_4$, voltage $v_a$ increases to its peak voltage. Diode Dy will be turned off; and next switching cycle begins.

From the above analysis, it can be seen that the rectified AC line current is equal to the capacitor charging current during the time period from time $t_1$ to time $t_2$. Therefore, the average C line current over one switching cycle equals the average capacitor charging current, which is the total charge variation from time $t_1$ to time $t_2$. The charge variation of capacitor Cin is $$\Delta Q = Cin(V_{c,max} - V_{c,min}) \qquad (5)$$

Substituting voltages $V_{c,max}$ and $V_{c,min}$ into equation (5) yields the rectified line current in a switching cycle, given by $$|i_{in}| = i_{x,ave} = \frac{\Delta Q}{T_s} = C_{in}f_s(|v_{in}| + 2V_a - V_{dc}) \qquad (6)$$

The input power $P_{in}$ is the average value of the product of voltage $v_{in}$ and current $i_{in}$ over one line cycle, which is $$P_{in} = \frac{1}{2}f_sC_{in}\left[V^2_{in,p} + \frac{4}{\pi}(2V_a - V_{dc})V_{in,p}\right] = P_0, \qquad (7)$$

where $V_{in,p}$ is the line peak voltage. During the preheat and start-up operations, the lamp is not turned on. The output power $P_0$ of the circuit is smaller than that of the normal operation. The switching frequency at preheat mode is higher than that of normal lighting frequency, and the lamp voltage $2V_a$ at start-up mode is much higher than that of normal lighting operation. In order to maintain the relationship shown in equation (7), the DC bus voltage $V_{dc}$ has to increase at preheat and start-up modes. Therefore, one of the main disadvantages is high DC bus voltage stress at preheat and start-up mode operations. As a result, high voltage bulk capacitor and high voltage rating power devices must be used, which increase the cost of the device. Another main disadvantage is the high lamp crest factor. Usually, the higher the lamp crest factor, the shorter the lamp life. The high crest factor of the circuit of FIG. 1 is mainly due to a modulation of capacitor Cin on the resonant tank. Capacitor Cin is equivalently in parallel with the resonant capacitor Cr when either diode Dx or diode Dy is on. The equivalent resonant tank of FIG. 1 is shown in FIG. 4A. The equivalent resonant capacitor is Cr, and capacitors Cr+Cin near the zero crossing of the line input voltage and near the line peak voltage, respectively. Since capacitor Cin is much higher than capacitor Cr, the equivalent resonant capacitor of FIG. 1 significantly changes over the line cycle. As a result, the lamp crest factor becomes high at constant frequency and constant duty ratio control. Another disadvantage is that the rectified line current through diode Dx is discontinuous, thereby requiring a large line input filter to be used.

U.S. Pat. No. 5,410,466, also hereby incorporated by reference, discloses the same basic circuit as shown in FIG. 1 by adding a new control for controlling the switching frequency and duty ratio of two switches S1 and S2 to achieve smooth lamp current with a constant envelope and low crest factor. However, the circuit of U.S. Pat. No. 5,410,466 still suffers from high DC bus voltage stress at preheat and start-up modes and discontinuous line input current so that a large line input filter has to be used.

To reduce the DC bus voltage stress at start-up for the circuit of FIG. 1, one alternative is to reduce voltage $v_a$ at preheat and start-up modes. The method is disclosed in a paper entitled "Reduction of voltage stress in charge pump electronic ballast," published in IEEE Power Electronics Specialist Conference Proceedings, pp. 887–893, 1996. The circuit is shown in FIG. 5, where a second resonance, composed of inductor $Lr_2$ and capacitor $Cr_2$, is inserted to the circuit of FIG. 1. During preheat and start-up modes, the switching frequency is close to the second resonant frequency of inductor $Lr_2$ and capacitor $Cr_2$ so that a low impedance is connected and voltage $v_a$ is reduced, while still obtaining enough lamp voltage to ignite the lamp. Therefore, the DC bus voltage $V_{dc}$ can be reduced. By adding two clamping diodes $Dr_1$ and $Dr_2$, unity power factor can be achieved and also a low lamp crest factor can be simultaneously achieved. However, two resonant inductors must be used, which increases the cost of the device. Furthermore, the switch suffers from high current stress. This switching current is about one and one-half times the switching current of the circuit of FIG. 1. Therefore, devices having a high current rating must be used, which also increases the cost of the device.

Other known devices are disclosed in U.S. Pat. Nos. 5,404,082 and 5,410,221. The circuits of these two patents are shown in FIG. 6A. Capacitor Cin is in parallel with diode Dy to suppress the input current distortion and achieve a high power factor. The construction of FIG. 6A is different from FIG. 1. The equivalent circuit of FIG. 5 can be expressed as FIG. 7, where the series resonant tank is considered a high frequency current source with a constant amplitude. There are four operational modes for the circuit of FIG. 6A, as illustrated in FIGS. 6B–6E. The four equivalent topological stages and switching waveforms are shown in FIGS. 6B–6E.

Mode 1 [$t_0$~$t_1$]: As shown in FIGS. 6B and 8, before time $t_0$, the source current $i_s$ has a negative value, and it flows through the diode Dy. The voltage at node m is clamped to the bus voltage $V_{dc}$. At time $t_0$, source current $i_s$ becomes positive and begins to charge capacitor Cin The charge capacitor voltage $v_c$ begins to rise while voltage $v_m$ decreases. So, charge capacitor Cin accumulates energy from the DC bus. This mode terminates at time $t_1$, where the voltage at node m decreases to the line input voltage, and diode Dx starts to conduct. The time interval $t_1$ is determined by:

$$t_1 = \frac{1}{\omega}\mathrm{arc}^{-1}\cos\left[1 - \frac{\omega_s C_{in}}{I_s}(V_{dc} - |V_{in}|)\right], \tag{8}$$

where $\omega_s$ is the frequency of source current $i_s$, and $V_{dc}$ is the voltage across the bulk capacitor $C_B$. The total charge variation in capacitor Cin is given by:

$$\Delta Q = C_{in}(V_{dc} - |V_{in}|). \tag{9}$$

There is no input line current during this stage.

Mode 2: [$t_1$, $t_2$]: Referring to FIGS. 6C and 8, at time $t_1$, diode Dx begins to turn on and voltage $v_m$ is clamped to the rectified line input voltage. Source current $i_s$ flows through the line input and diode Dx. Therefore, the high frequency source current $i_s$ flows through the line input and diode Dx. Therefore, the high frequency source current $i_s$ absorbs energy directly from the AC line. At $t_2 = T_s/2$, source current $i_x$ becomes negative, while diode Dx is naturally turned off, and this mode ends. During this time interval, the rectified line current $i_x$ is given by:

$$i_x = i_s = I_s \sin \omega_s t \quad t_1 < t < t_2 \tag{10}$$

Mode 3 [$t_2$, $t_3$]: As illustrated in FIGS. 6D and 8, at time $t_2$, source current $i_s$ becomes negative and diode Dx is naturally off. Since voltage vm is still lower than the DC bus voltage $V_{dc}$, diode Dy cannot be turned on at this time. Source current $i_s$ is discharging capacitor Cin and the voltage at node m increases. Voltage $v_m$ rises to the DC bus voltage, where diode Dy starts to conduct at time $t_3$.

Mode 4 [$t_3$, $t_4$]: As shown in FIGS. 6E and 8, at time $t_3$, diode Dy begins to flow the current source $i_s$, and the voltage at node m is clamped to the DC bus voltage until $i_s$ becomes positive, and diode Dy is naturally turned off at time $t_4$=Ts. The rectified input line current equals the average diode current $i_x$ over one switching cycle, which is given by:

$$|i_{in}| = i_{x,ave} = \frac{1}{T_s}\int_{t0}^{t4} i_x\, dt = \frac{1}{T_s}\int_{t1}^{t2} i_s\, dt, \tag{11}$$

where Ts is the switching period. After substituting $i_s$ into the above equation, we have $$|i_{in}| = \frac{I_s}{\pi} - \frac{\Delta Q}{T_s} \tag{12}$$

where ΔQ is the charge variation of capacitor Cin and $\Delta Q = Cin(V_{dc} - |v_{in}|$. Therefore, the rectified line current $i_x$ in one switching period is $$|i_{in}| = \left(\frac{I_s}{\pi} - C_{in} f_s V_{dc}\right) + C_{in} f_s \left|v_{in}\right|. \tag{13}$$

In order to achieve the unity power factor, the average input current should be proportional to the line input voltage. The first term of the above equation should be zero, which is given by $$I_s = \pi C_{in} f_s V_{dc}. \tag{14}$$

This equation (14) is the unity power factor condition. The equation (13) becomes $$i^{ave}_{x}=C_{in}f_s|V_{in}|. \quad (15)$$

Equation (15) shows that the unity power factor can be obtained as long as equation (14) can be satisfied. The input power is the average value of the product of voltage $v_{in}$ and current $i_{in}$ over one line cycle, which is $$P_i = \frac{2V_{in,p}}{\pi}\left(\frac{I_s}{\pi} - C_{in}f_sV_{dc}\right) + \frac{1}{2}C_{in}f_sV_{in,p}^2 = P_0. \quad (16)$$

During the preheat and start-up operations, the lamp is not turned on. The output power $P_0$ of the circuit is smaller than that of the normal operation. The switching frequency at preheat mode is higher than that of normal lighting frequency, and the circulating current at light load during the start-up mode is much higher than that of normal lighting operation. In order to maintain equation (16), the DC bus voltage $V_{dc}$ must increase at preheat and start-up modes. Therefore, one of the main disadvantages is a high DC bus voltage stress at preheat and start-up mode operations. This basic problem is the same as the circuit of FIG. 1. For the circuit of FIG. 6A, when diode Dy is conductive, capacitor Cin is shorted. The resonant tank consists of inductor Lr, capacitors Cr and Cin when both diodes Dx and Dy are non-conductive. Therefore, this circuit also has two resonant modes in one switching cycle, which causes the same problem that an envelope of the lamp current varies with the line input voltage. As a result, the lamp crest factor increases and the lamp life becomes shorter. Although U.S. Pat. Nos. 5,404,082 and 5,410,021 proposes a control scheme to suppress the lamp crest factor, the DC bus voltage stress at the preheat and start-up mode still exists, which requires high voltage rating bulk capacitor $C_B$ and power switches S1 and S2. Besides, the input current is discontinuous so that a large line input filter must be used.

U.S. Pat. No. 4,511,832 discloses a circuit as shown in FIG. 9. The input inductor Li and capacitor Ci are used to suppress line input current harmonics and reduce the input current ripple. Capacitor C1 provides a path to absorb energy from the line input every switching cycle, while capacitor C2 provides another path to the bulk capacitor for the series resonant parallel-loaded tank composed of inductor Lr and capacitor Cr. The DC bus voltage $V_{dc}$ across the bulk capacitor $C_B$ is suppressed by conducting the thyristor T when the DC bus voltage exceeds a certain value. Thus, the cost increases and the control circuit becomes complicated.

Japanese Patent No. P0-222469 discloses a lamp driving circuit shown in FIG. 10. The main purpose of adding inductor Li is to improve a total harmonic distortion (THD), reduce line input current harmonics. Inductor Li is used as a boost inductor. The current through inductor Li can flow through diode Dy to charge the bulk capacitor $C_B$, without flowing through the power switch. So, the switching current stress of switches S1 and S2 becomes small. But, there is still a high DC bus voltage stress across the bulk capacitor $C_B$ at start-up mode so that high voltage rating bulk capacitor and power switches must be used, which significantly increases cost. Besides, the high crest factor also still exists.

Another prior art is disclosed in Japanese Patent No. P06-284748, the circuit of which is shown in FIG. 11. This circuit is basically the same as the circuit of FIG. 6A except for the addition of an input inductor Li. Input inductor Li is used to minimize the input line current ripple so that a small input filter can be used. Diode D1 is used to improve THD. However, this circuit still suffers from high DC bus voltage across $C_B$ at the start-up mode and also from high lamp crest factor at normal light operation.

U.S. Pat. No. 5,521,467 discloses the use of an inverter for supplying a high frequency energy to the lamp. The circuit is shown in FIG. 12. An inductor Li and a full wave rectifier composed of diodes $D_1$–$D_4$ are provided to achieve high power factor. Capacitor C1 and inductor Li form a low pass filter so that the input rectified current through inductor Li is continuous. The function of capacitor $C_g$ is like capacitor Cin in the circuit of FIG. 1, while the function of capacitor $C_s$ is similar to capacitor Cin in the circuit of FIG. 6A. The main disadvantage is that high DC bus voltage across capacitor $C_B$ at the start-up mode. For the circuit FIG. 12, the circuit is shut down once the DC bus voltage exceeds a set value through the control circuit. Another drawback is that the component count is not reduced, compared with those of the two-stage approach. As a result, the cost cannot be reduced.

All these prior circuits are designed only with +10% line input voltage variation. They suffer from a large lamp power variation, high lamp crest factor, high THD, and high DC bus voltage stress at the start-up over a wide range line input voltage. Therefore, different designs must be taken for the different line input voltages. As a result, the circuit components are made different. The research and product development cycle becomes longer, which also increases the cost of the device.

SUMMARY OF THE INVENTION

The present invention has been accomplished in view of the above problems and insufficiencies. The main objective is to develop a gas discharge lamp inverter which is capable of suppressing the DC bus voltage stress at the start-up mode, providing constant lamp power, low lamp crest factor of the lamp current, less circulating current, less switching current stress, and a continuous line input current over a wide range line input voltages from 180V to 265V. The present invention circuit comprises a rectifier for rectifying an AC voltage from an AC voltage source to give a DC voltage, a smoothing capacitor for smoothing the DC voltage from rectifier into a smoothed DC voltage, and an inverter including switches turning on and off at a high frequency for converting the smoothed DC voltage to a high frequency square voltage waveform. The inverter is connected to the load circuit which is composed of a gas discharge lamp and a resonant circuit. The resonant circuit is composed of an inductor and a capacitor, and the lamp is connected in parallel with the resonant capacitor so that the lamp absorbs a high frequency energy from the resonant circuit. A control circuit gives a control signal to turn on and off the switches of the inverter and controls the constant lamp power over a wide range line input voltage. An input inductor is connected to a line rectifier to get the continuous line input current near the line peak voltage and a discontinuous line input current near the zero crossing of the line voltage. Two capacitors are in parallel with two diodes to suppress the DC bus voltage at the start-up and to achieve a low lamp crest factor at normal lighting operation.

Therefore, the main objective of the present invention is to reduce the DC bus voltage at the start-up mode, and to provide a constant lamp power, low crest factor and less circulating current, and less switching current with a small input filter over a wide range line input voltage.

BRIEF DESCRIPTION OF THE DRAWINGS

For a more detailed description of the embodiments of the present invention, reference should be made to the appended drawings, wherein.

DETAILED DESCRIPTION OF THE PREFERRED EMBODIMENTS

Figure 13:
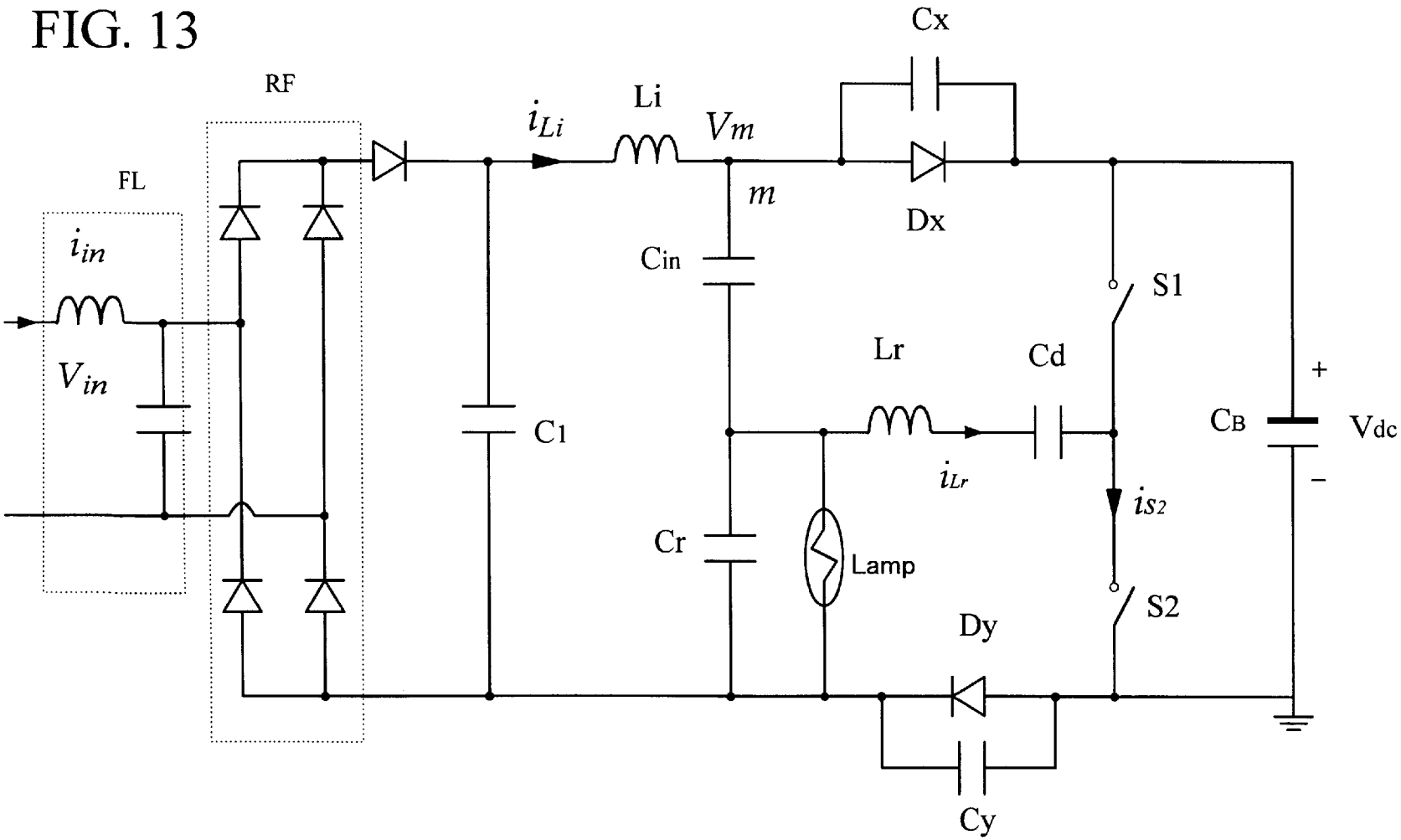
FIG. 13 is a circuit diagram of an embodiment of the present invention.

Referring now to FIG. 13, there is shown a circuit in accordance with a preferred embodiment of the present invention. The circuit comprises a fullwave rectifier RF connected to a source voltage through a high-frequency blocking filter FL to provide a rectified DC voltage, a smoothing capacitor $C_B$ connected across the rectifier RF through diodes Dx and Dy, and an inverter composed of a series connected pair of switches S1 and S2, a capacitor Cd, and a resonant tank of a resonant inductor Lr and a resonant capacitor Cr. A discharge lamp is connected across the resonant capacitor Cr. The inverter is energized by a voltage $V_{dc}$ across the smoothing capacitor $C_B$ to alternately turn on and off the switches S1 and S2 at a high frequency for providing an high frequency alternating current to drive the discharge lamp. Switches S1 and S2 are controlled in a feedback manner by a constant lamp power control circuit of FIG. 16 to turn on and off at varying frequencies, as will be discussed later.

Capacitor Cin is connected in series with resonant capacitor Cr across the rectifier RF through an inductor Li for reducing distortion of an input current. A DC bus voltage $V_{dc}$ across capacitor $C_B$ is determined by an unbalance between input power and output power. If the input power is higher than needed at a load, the DC bus voltage increases, while the DC bus voltage is low when the input power is low in response to less load. The input power delivered to the bulk capacitor $C_B$ will go through diodes Dx and Dy. To reduce a DC bus voltage stress at a start-up mode, two capacitors Cx and Cy are added in parallel with the diodes Dx and Dy, respectively. Because an average current through two capacitors Cx and Cy is equal to zero over one line cycle, a net power delivered to the bulk capacitor $C_B$ through capacitors Cx and Cy equals zero. Capacitors Cx and Cy have to be totally discharged before the diodes Dx and Dy are turned on. The total charge stored in these capacitors reach the maximum near the zero crossing of the line input voltage. This stored charge in capacitors Cx and Cy is discharged by the resonant inductor current $i_{Lr}$ in a resonant tank including inductor Lr and capacitor Cr.

Figure 14:
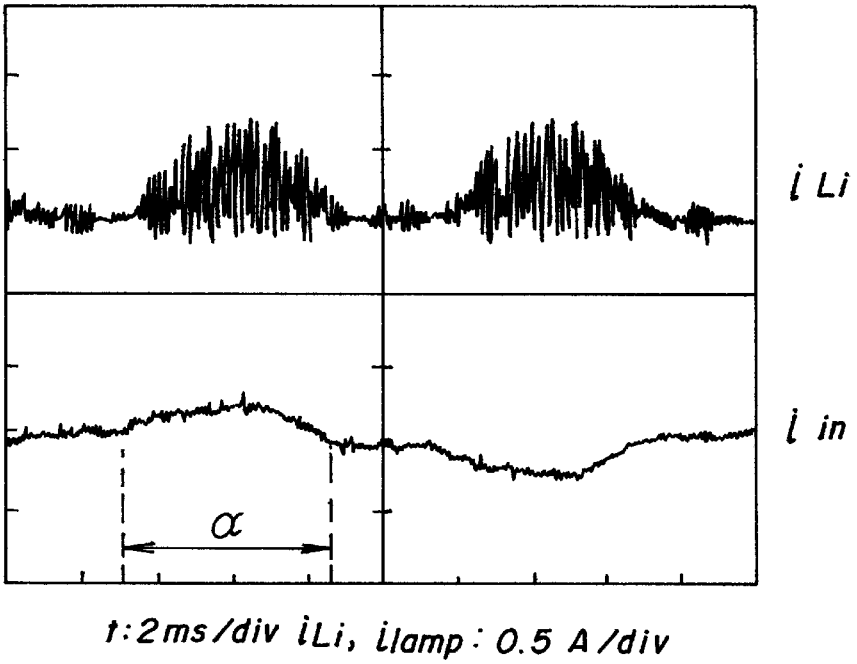
FIGS. 14 and 15 are charts illustrating waveforms of an input current and an inductor current in the circuit of FIG. 13, respectively at the start-up and at the normal lighting operation.

In the circuit of FIG. 13, the resonant capacitor Cr can be designed to be very small since the input current is continuous. Therefore, the discharging resonant inductor current is very small even at start-up. Start-up, or start-up mode, is a condition wherein current is provided to filaments of the lamp which is sufficient to raise the filament temperature while providing a lamp voltage which is less than an ignition voltage across the lamp, and subsequently providing ignition voltage across the lamp to illuminate the lamp. During the start-up mode, the lamp is not illuminated, and the filaments are dissipating energy. This results in the circuit operating in a light load. After the lamp is illuminated, the lamp enters a dimming mode wherein lamp power is less than full lamp power, and then in a steady state wherein the lamp operates in a full output power by reducing the switching frequency. The charge stored in the capacitors Cx and Cy are not able to be totally discharged near the zero crossing of the line input voltage. Consequently, diodes Dx and Dy cannot be turned on at this time, and the conduction angle a of diodes Dx and Dy becomes smaller, as shown in FIG. 14. There is no input current near a wide range of the zero crossing of the line input voltage. Therefore, the input power is reduced at the start-up mode, which is desirable since the lamp is not on, which means that the output power is also small. Therefore, the DC bus voltage is suppressed. In addition, a variation range of voltage $v_m$, the bigger the absorbed energy from the line input in inductor Li. However, the resonant inductor current $i_{Lr}$ can be designed to be very small at start-up. So, a peak-to-peak voltage of voltage $v_m$ is also small so that the inductor Li absorbs less energy from the line input over one switching cycle, compared with the prior art circuits with a high circulating current. Thus, the DC bus voltage also can be reduced. Besides, the switching frequency at a preheat and the start-up modes are higher than that of the normal light operation. The input inductor Li gives a high impedance at high frequencies. So, this inductor is also able to help to reduce the DC bus voltage $V_{dc}$ across capacitor $C_B$.

Two capacitors Cx and Cy are added in order to improve the lamp crest factor. As discussed before, the high lamp crest factor is mainly due to a modulation of capacitor Cin on the resonant tank. Capacitor Cin is a part of the resonant tank when diode Dx or diode Dy is on. Since the conduction angle of the diodes becomes small, modulation of capacitor Cin on the resonant tank is reduced so as to improve the lamp crest factor.

Figure 1:
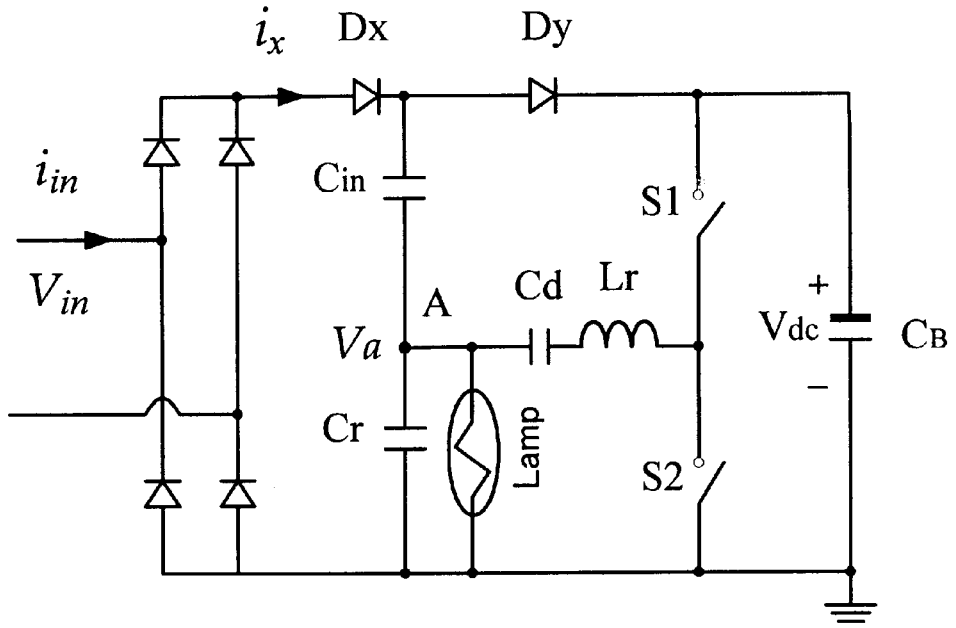
FIG. 1 (Prior Art)
FIG. 1 is a circuit diagram of a known circuit.
Figure 2:
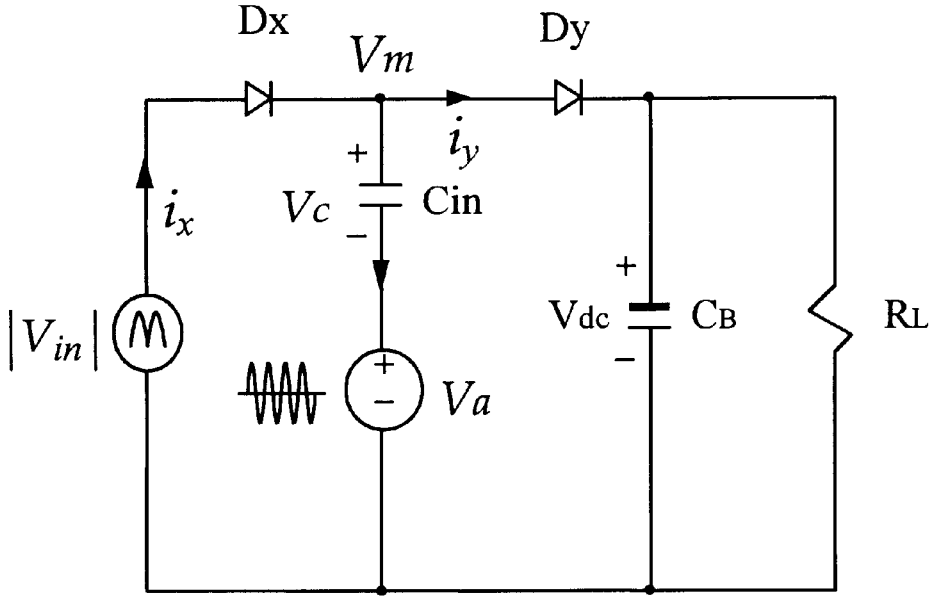
FIG. 2 (Prior Art)
FIG. 2 is a simplified circuit diagram equivalent to the circuit of FIG. 1.
Figure 3:
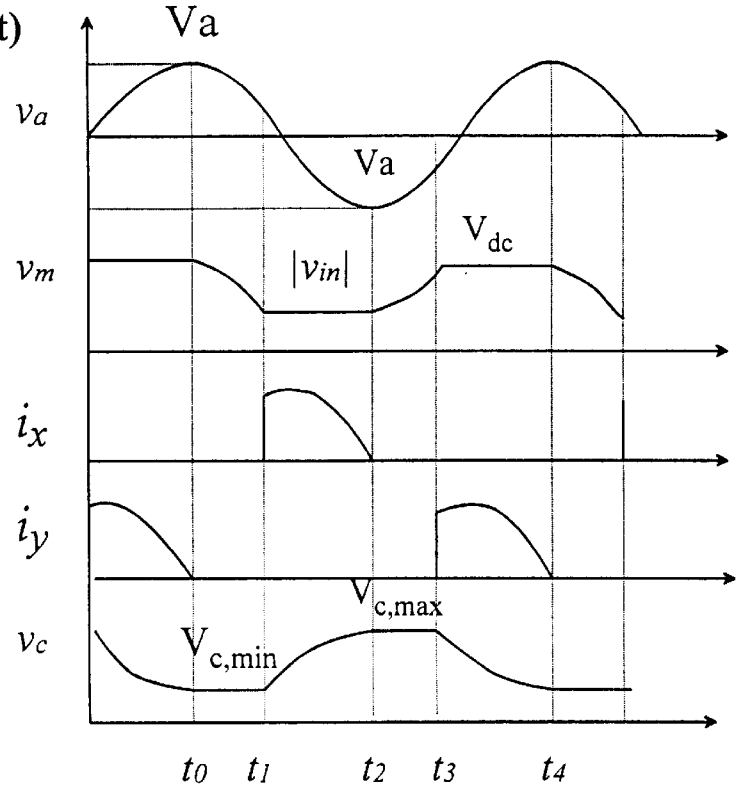
FIG. 3 (Prior Art)
FIG. 3 is a graph illustrating the operations of the above known circuit.
Figure 4A:
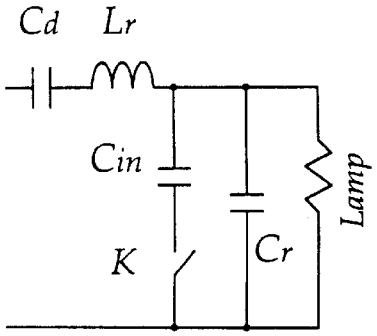
FIG. 4A (Prior Art)
FIGS. 4A to 4C are diagrams illustrating equivalent resonant tanks of the circuit of FIG. 1.
Figure 4B:
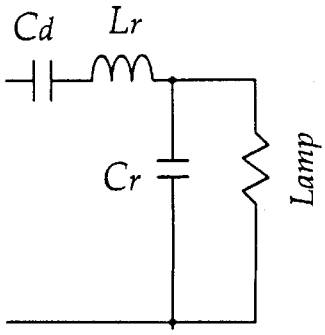
FIG. 4B (Prior Art)
Figure 4C:
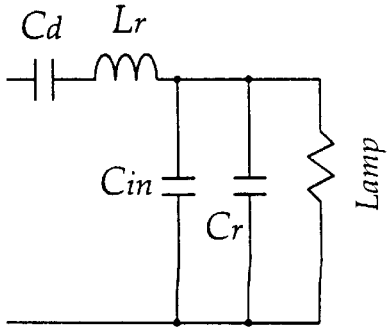
FIG. 4C (Prior Art)
Figure 5:
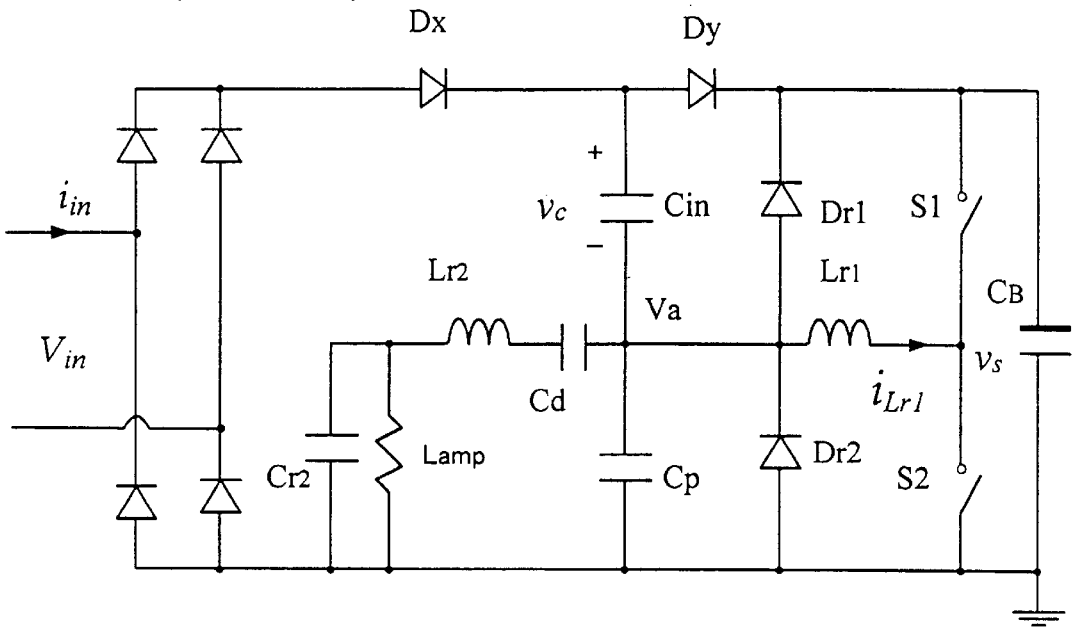
FIG. 5 (Prior Art)
FIG. 5 is a circuit diagram of another known circuit.
Figure 6A:
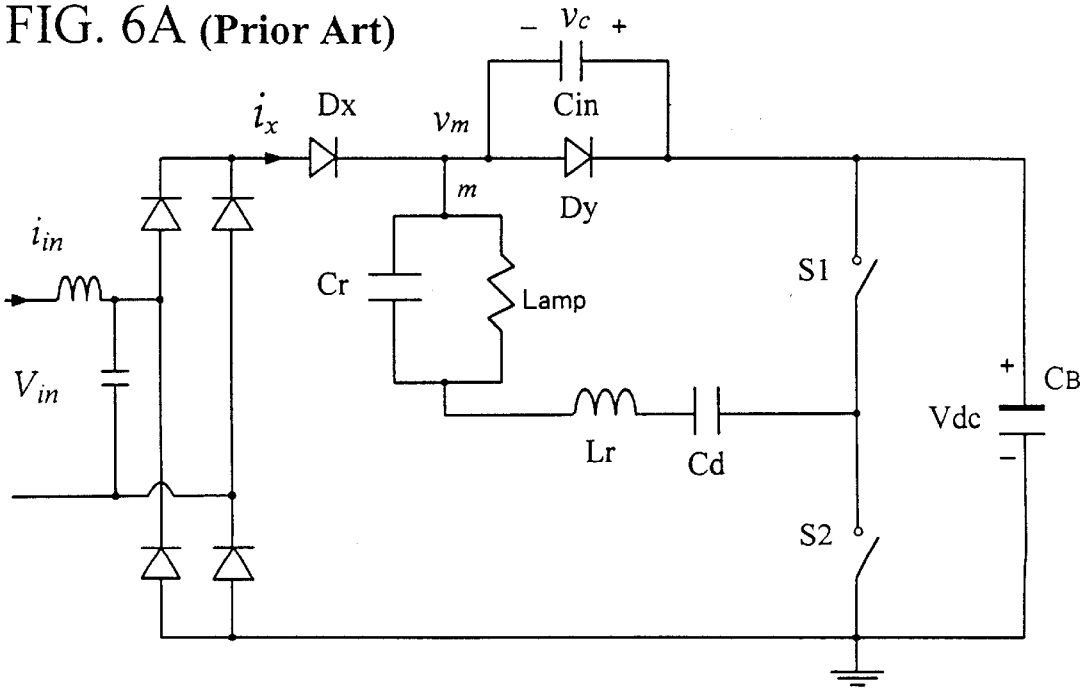
FIG. 6A (Prior Art)
FIG. 6A is a circuit diagram of a further known circuit.
Figure 6B:
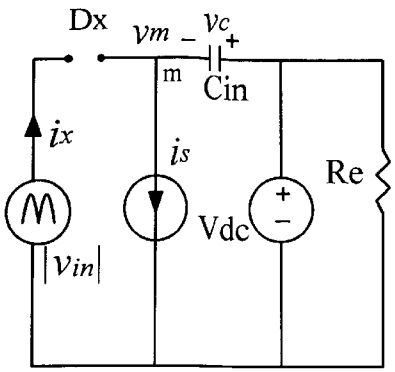
FIG. 6B (Prior Art)
FIGS. 6B to 6E illustrate operation modes of the circuit of FIG. 6A.
Figure 6C:
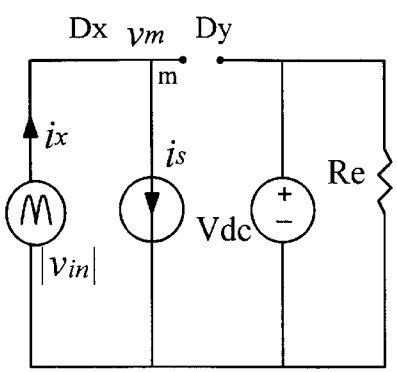
FIG. 6C (Prior Art)
Figure 6D:
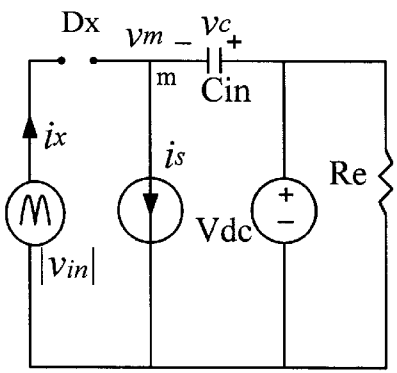
FIG. 6D (Prior Art)
Figure 6E:
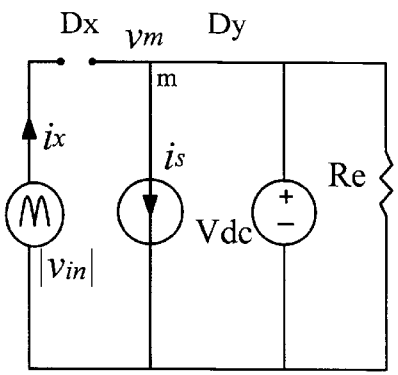
FIG. 6E (Prior Art)
Figure 9:
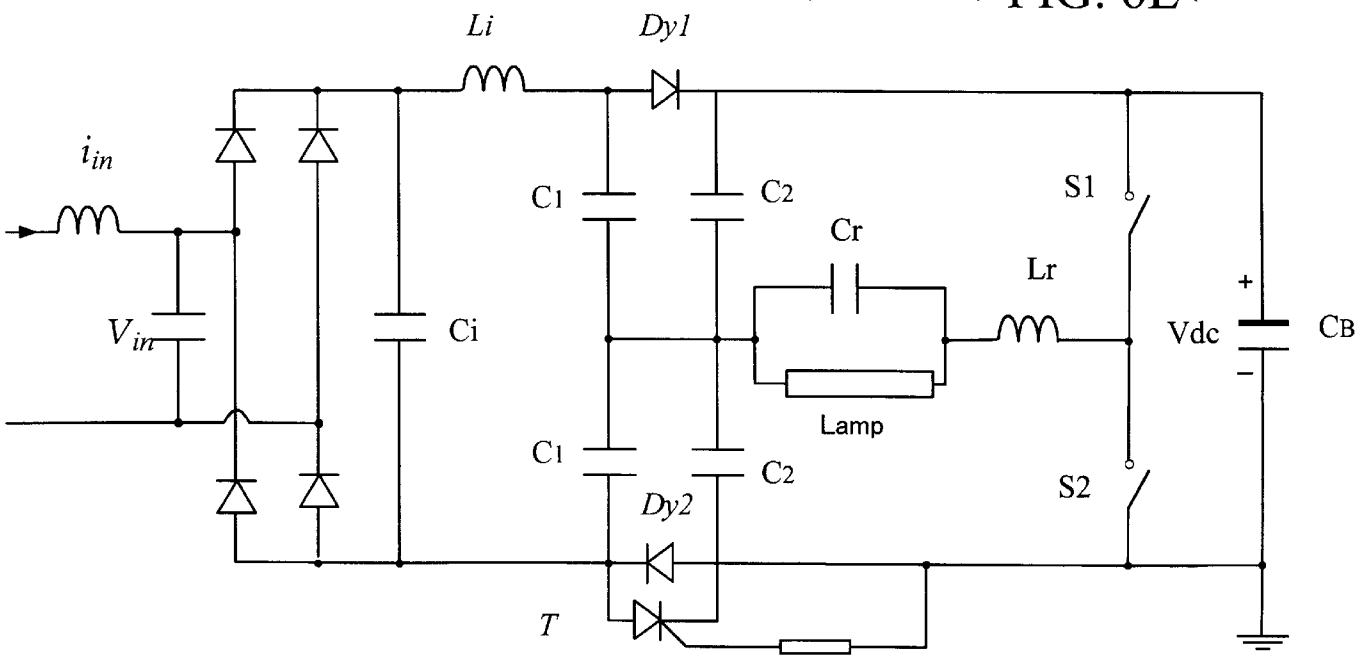
FIG. 9 (Prior Art)
FIGS. 9 to 12 are circuit diagrams of still further known circuits.
Figure 7:
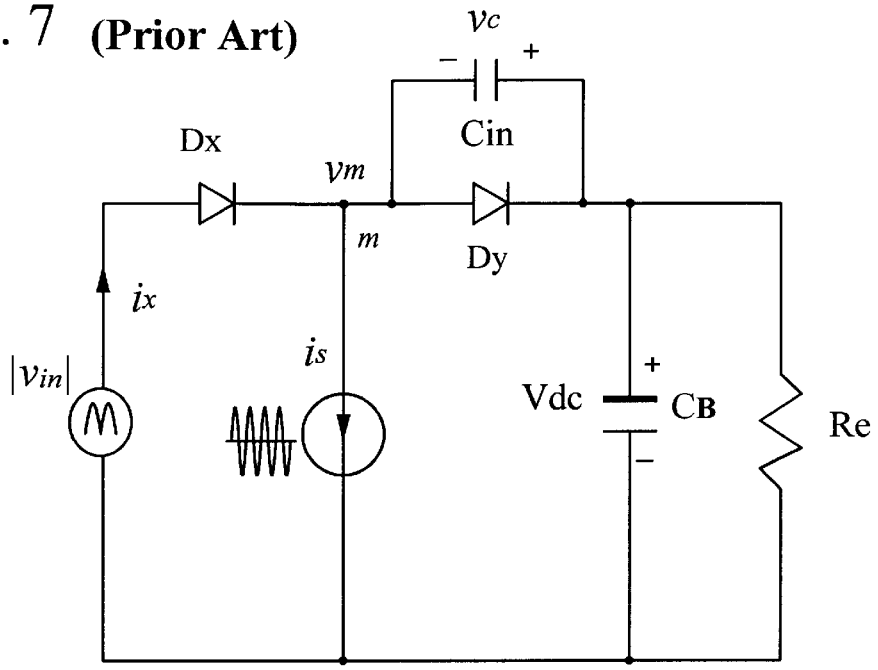
FIG. 7 (Prior Art)
FIG. 7 is a simplified circuit diagram equivalent to the circuit of FIG. 6A.
Figure 8:
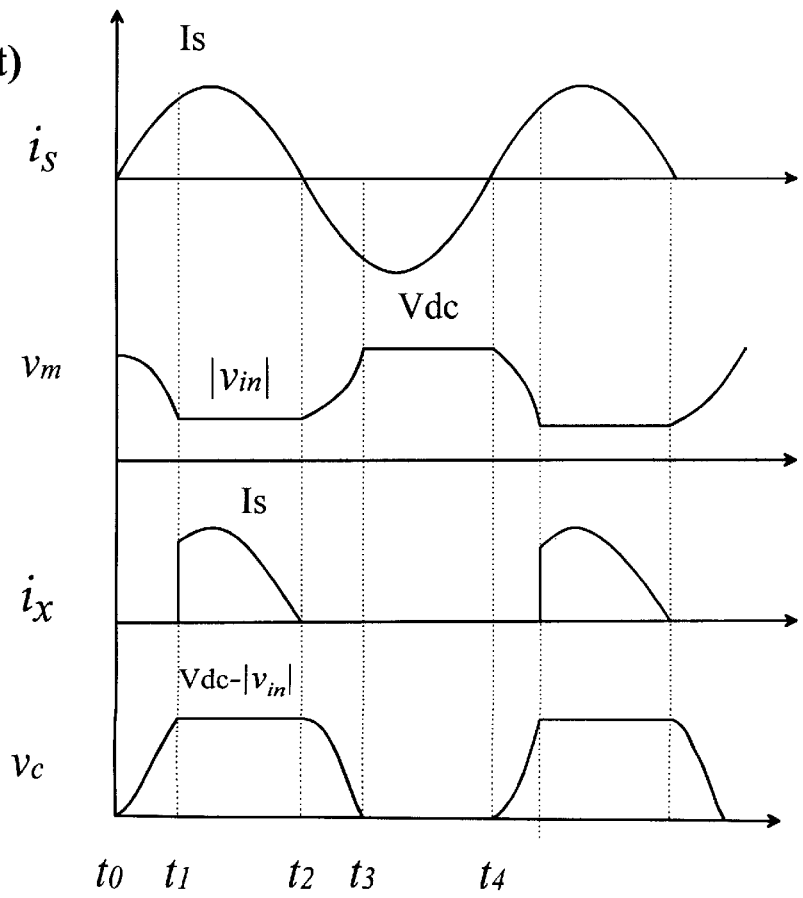
FIG. 8 (Prior Art)
FIG. 8 is a chart illustrating operations of the circuit of FIG. 6A.
Figure 10:
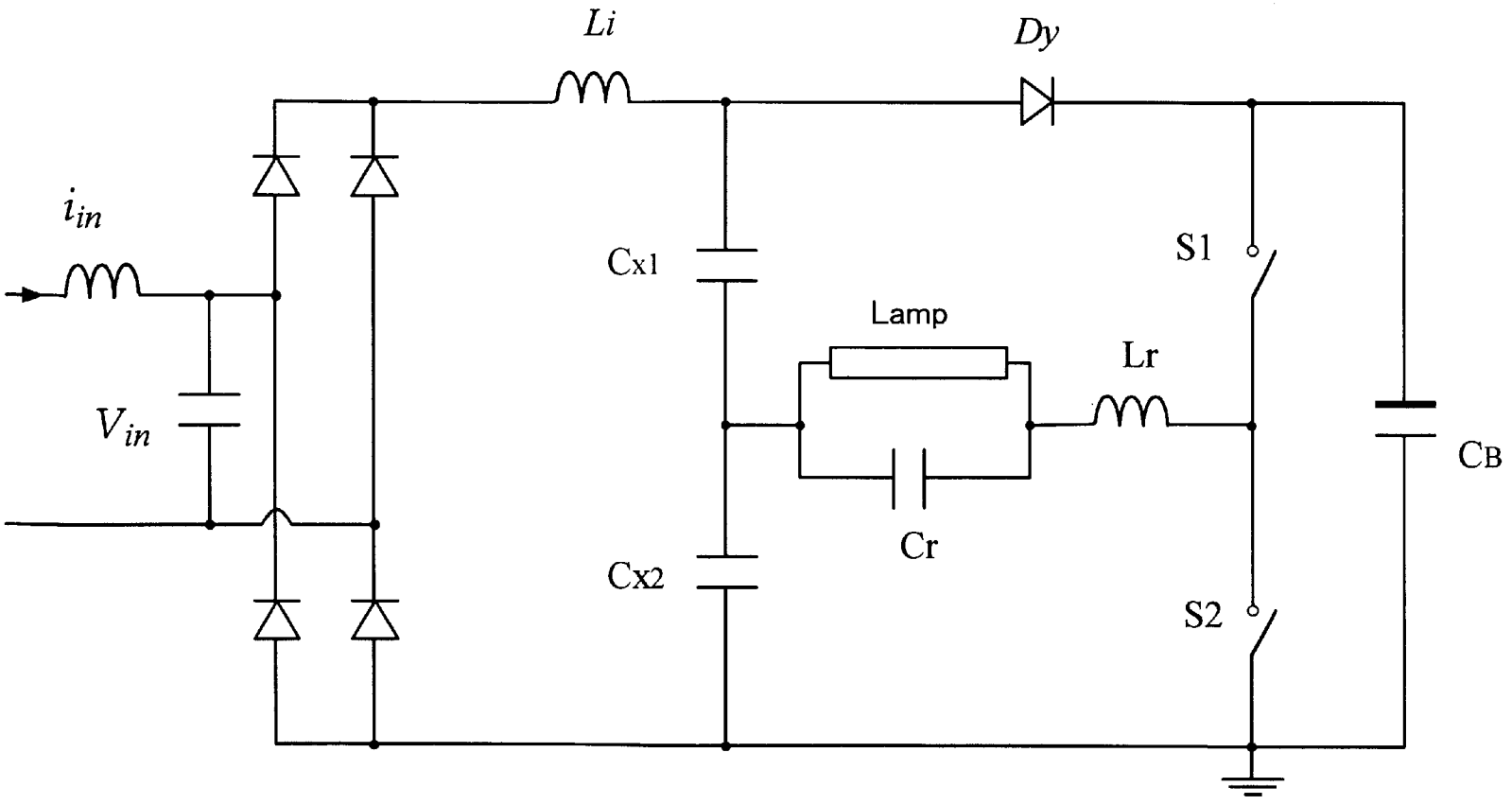
FIG. 10 (Prior Art)
Figure 11:
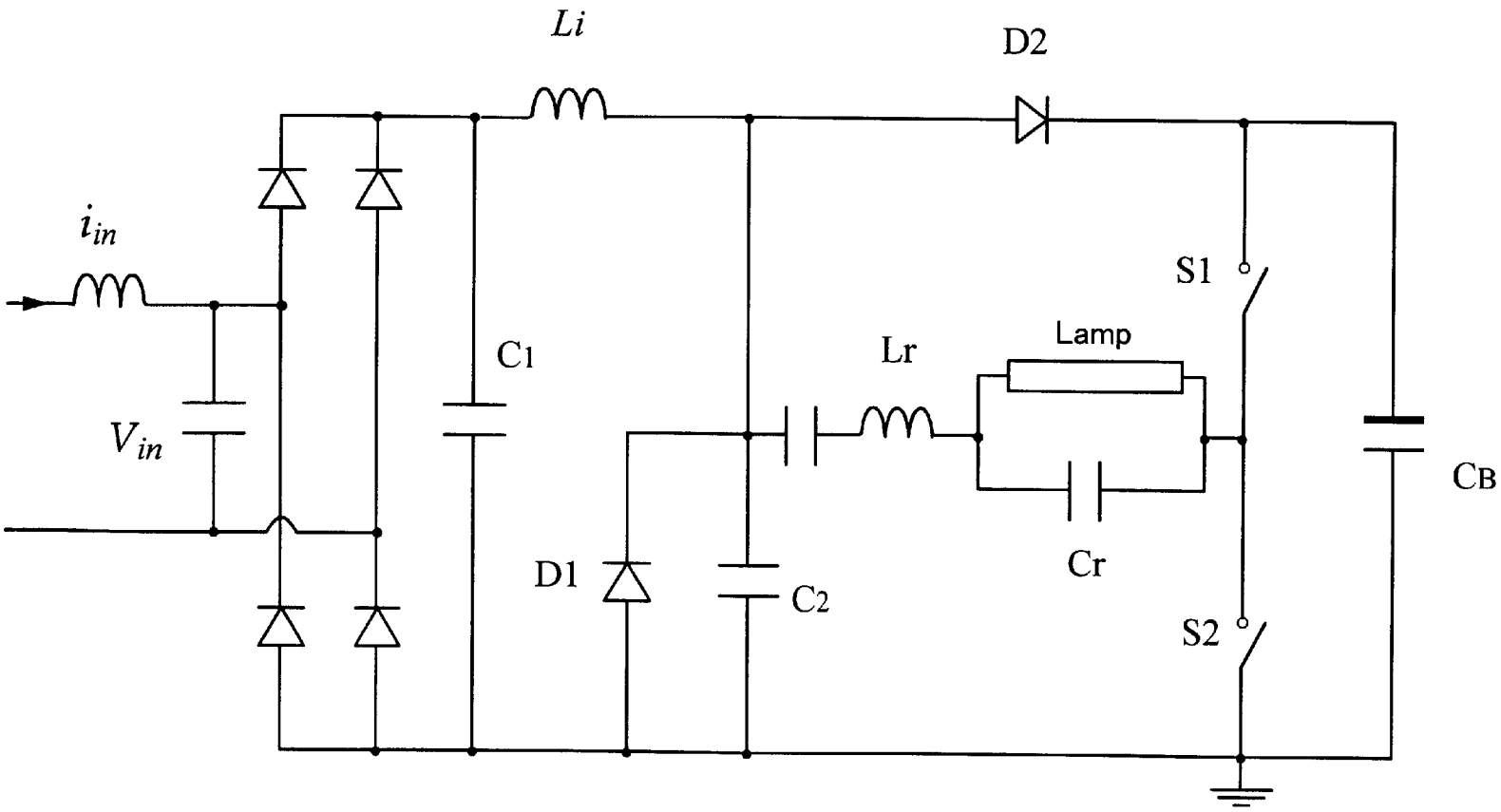
FIG. 11 (Prior Art)
Figure 12:
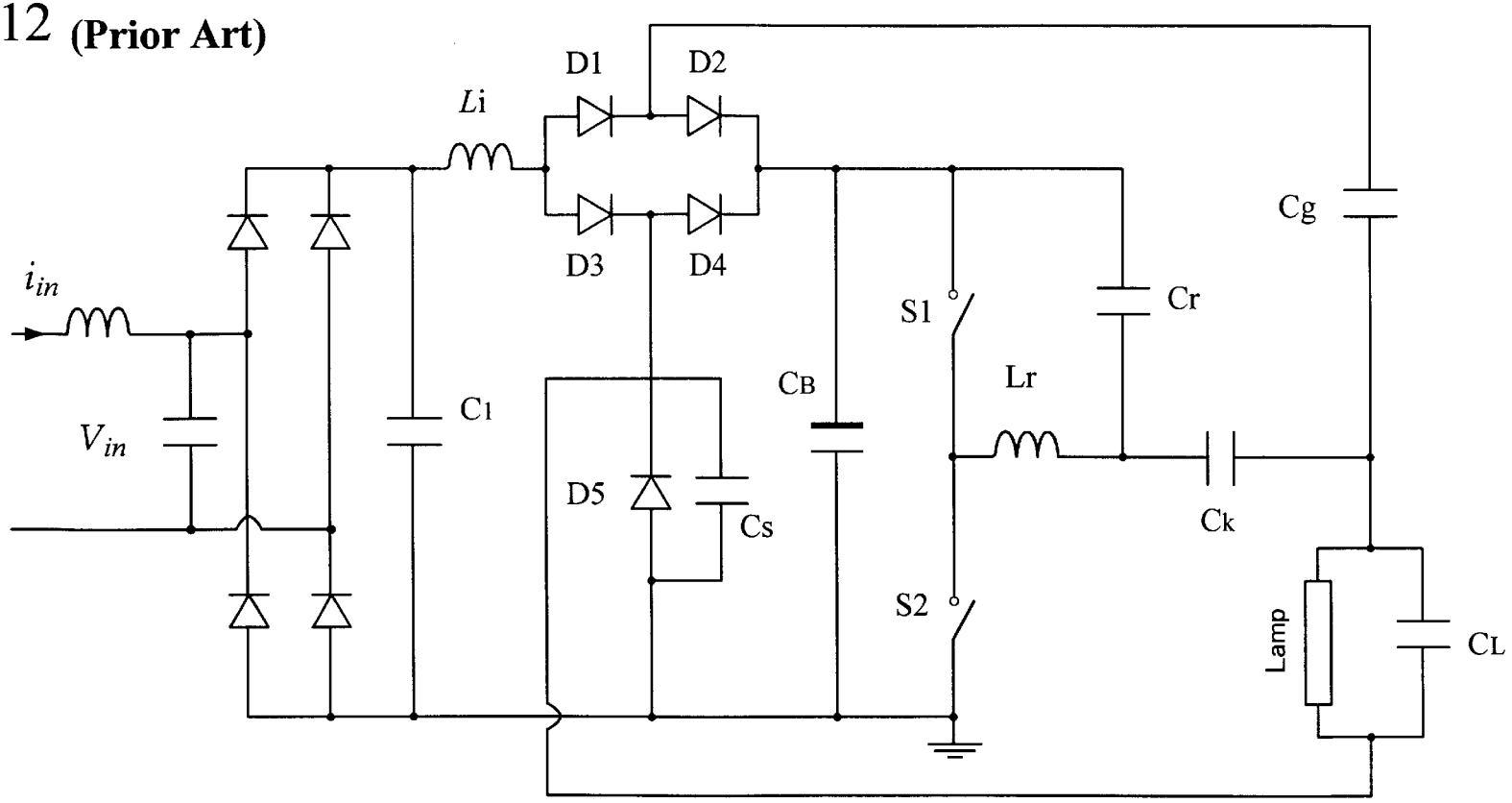
FIG. 12 (Prior Art)
Figure 15:
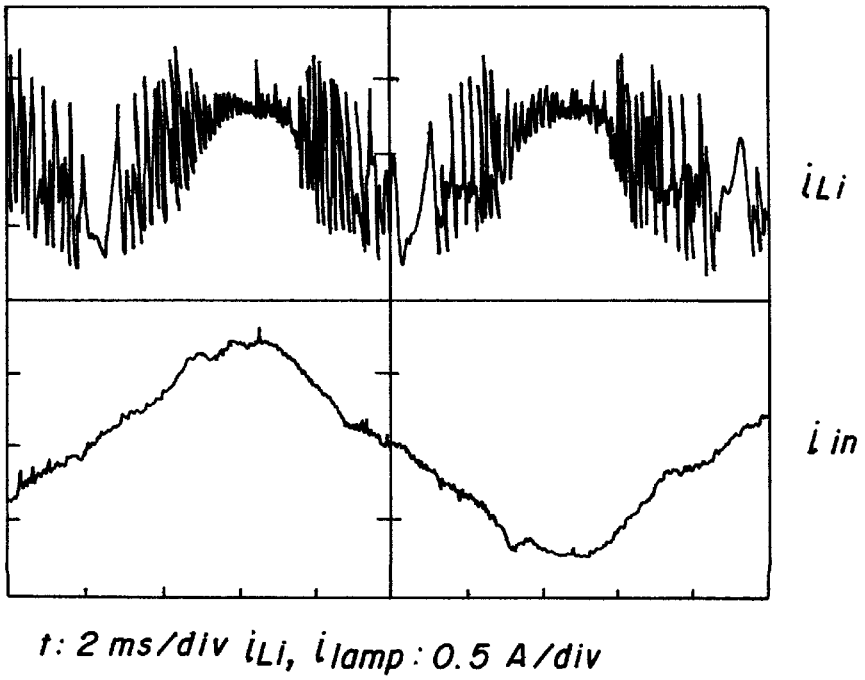

The input current is designed to be continuous near the line peak voltage, and discontinuous near the zero crossing of the line voltage so that the conduction angle $\alpha$ easily becomes small at the start-up mode to reduce the DC bus voltage stress. The input inductor Li, capacitors Cin, Cx and Cy are also used to achieve high power and reduce the line input current harmonics. The current through inductor Li at normal lighting operation is shown in FIG. 15. Since the current through inductor Li has continuous input current, a small line input filter can be used, which further reduces the cost of the device. The resonant capacitor is much smaller than that of other mentioned circuits in the prior arts. The circulating resonant current is low, which is about 70% circulating resonant current of FIG. 1 and FIG. 6A, 50% circulating resonant current of FIG. 5. So, the switching current stress is reduced, and therefore small current rating devices such as switches of the inverter can be used, which also reduces the cost.

Figure 16:
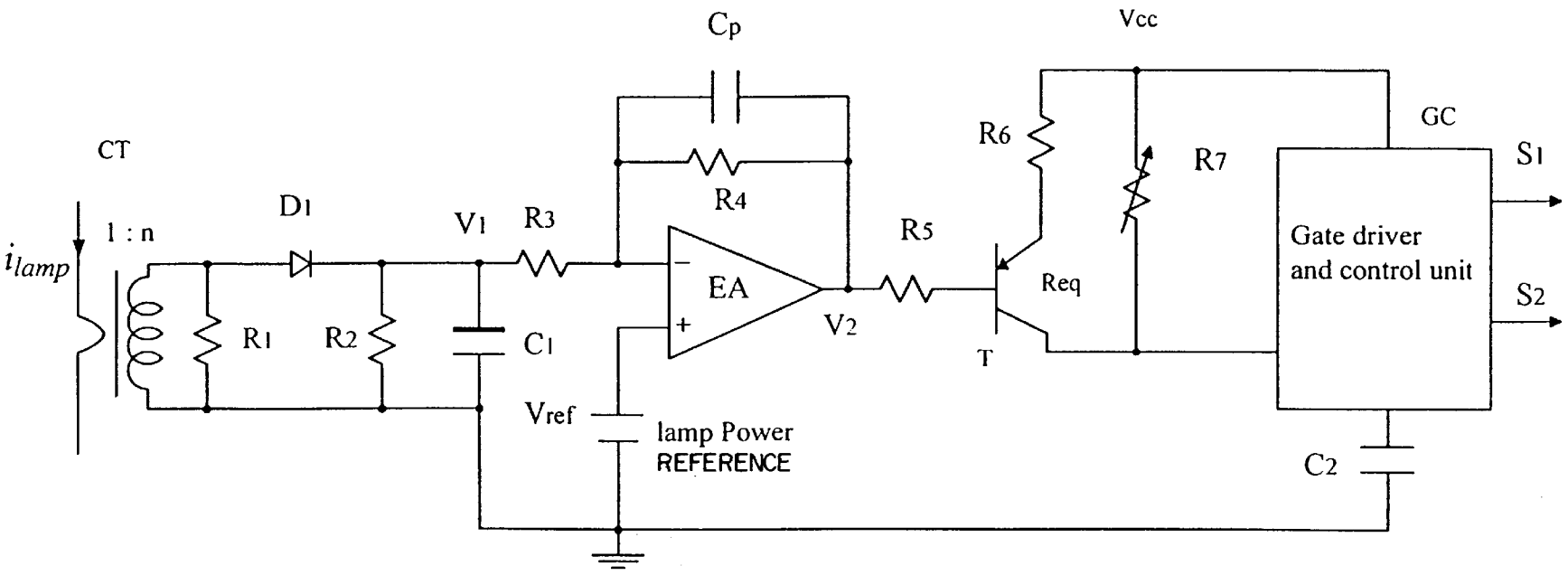
FIG. 16 is a circuit diagram of a control circuit for the circuit of FIG. 13.

As shown in FIG. 16, the constant lamp power control circuit comprises a detector for detecting at least one of an input voltage to an inverter and a load output from the inverter. The input voltage to the inverter could be an input current to the line rectifier, an input voltage to the rectifier or the output voltage to the inverter. The load output from the inverter may include a lamp current, a lamp voltage, a lamp power, or a resonant inductor current. The detected output voltage is used in a feedback circuit which modulates the control signal for achieving a constant lamp power and further reducing the low frequency ripple of the lamp current to improve the lamp crest factor. FIG. 16 shows one example of the control circuit using the lamp current as the detected signal.

The control circuit for providing the constant lamp power and reducing lamp current ripple comprises an error amplifier EA, which amplifies an error between the lamp current being detected and the reference voltage $V_{ref}$. The output voltage of the error amplifier Ea will control the switching frequency to modulate the lamp power and lamp current with a constant value. For example, when the line input voltage $v_{in}$ is high, a lamp current $i_{lamp}$ tends to be big. Thus, a detecting circuit provides a high output voltage $V_1$. Voltage $V_1$ is fed to the error amplifier EA and compared with the reference voltage $V_{ref}$ threat to output a low voltage $V_2$. Since voltage $V_2$ becomes small, the base current through the transistor T becomes big, and a resistance across collector and emitter of the transistor T becomes small, in response to which a gate driver and control unit GC operates to modulate control signals to switches S1 and S2 of the inverter in a direction of increasing the switching frequency thereof. With this result, the lamp current cannot increase with the line input voltage increase. The lamp power and lamp crest factor are thus controlled as a constant even over a wide range line input voltage.

Figure 17:
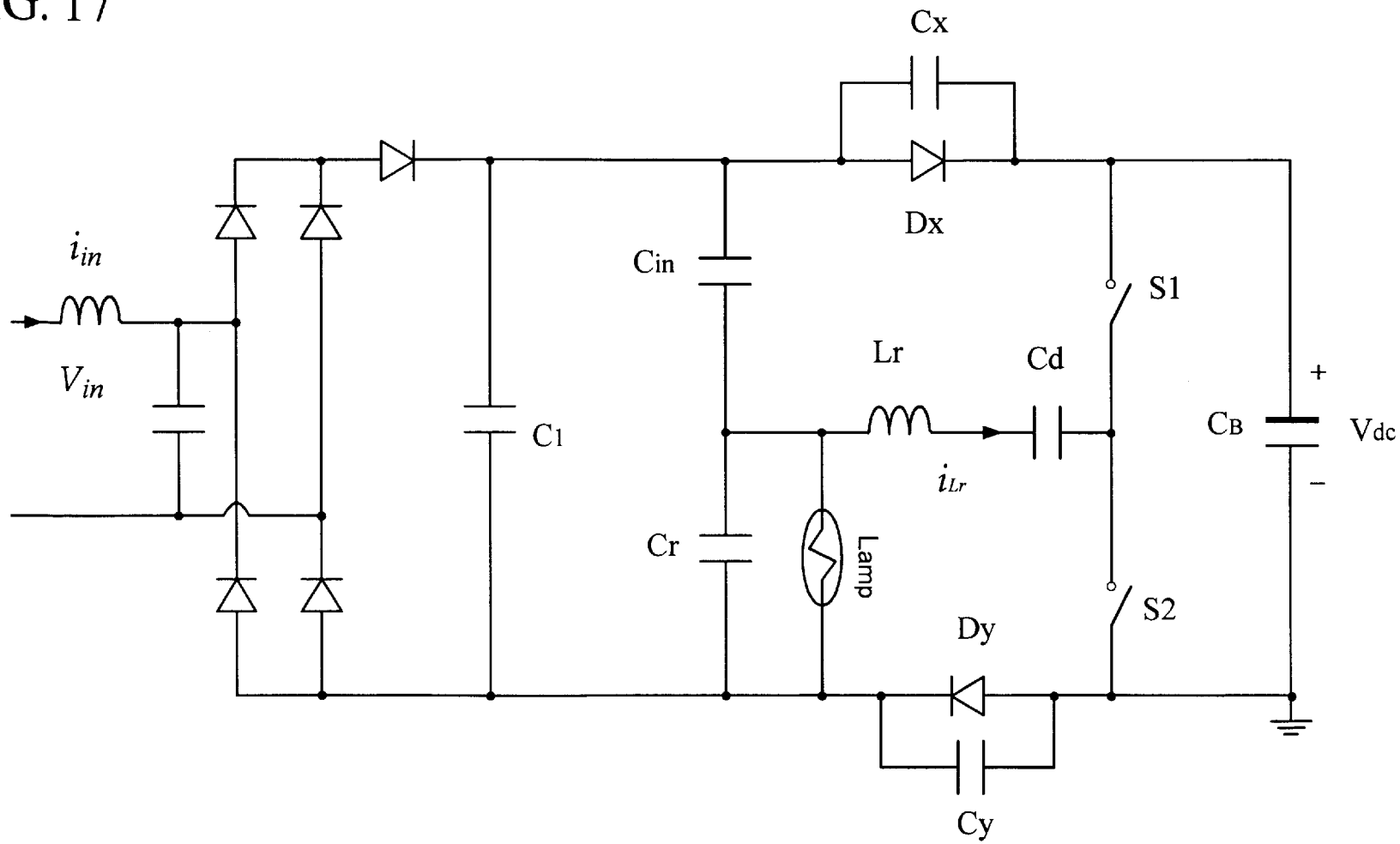
FIG. 17 is a circuit diagram of another embodiment of the present invention.

FIG. 17 illustrates another preferred embodiment of the present invention which is identical to the circuit of FIG. 13 except for removal of the input inductor Li. Removing inductor Li does not affect the normal lighting operation. Constant lamp power and low crest factor over a wide range line input voltage still can be achieved. Since two capacitors Cx and Cy are capable of reducing the modulation of capacitor Cin on the resonant tank, the low lamp crest factor and constant lamp power can be obtained even without any feedback control over ±10% line voltage variation. But, feedback control circuit of FIG. 16 is still needed to keep constant lamp power and low crest factor for a wide range line voltage. The line input current harmonics can be further reduced, as compared with the circuit of FIG. 13. However, the DC bus voltage $V_{dc}$ could be higher than that of FIG. 13 because the resonant capacitor Cr has to be larger. So, the circulating resonant current $i_{Lr}$ becomes large so that the conduction angle is large and DC bus voltage $V_{dc}$ increases. This DC bus voltage is still lower than that of the mentioned prior art circuits.

Figure 18:
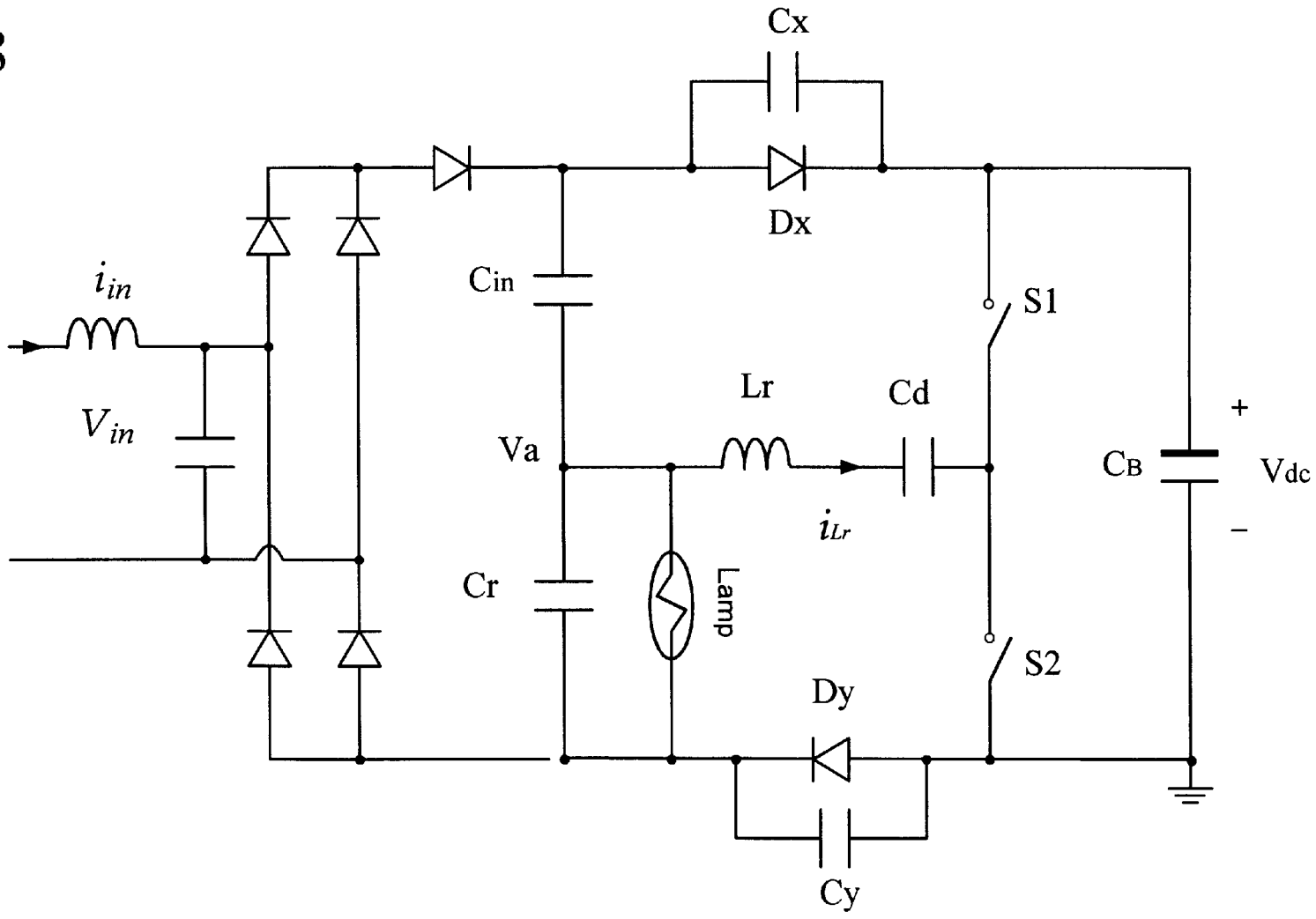
FIG. 18 is a circuit diagram of a further embodiment of the present invention.

FIG. 18 illustrates a further embodiment of the present invention which is identical to the circuit of FIG. 17 except for removal of capacitor C1 therefrom in order to further reduce the component counts. This circuit maintains low lamp crest factor and constant lamp power operation against a possible line voltage variation since two capacitors Cx and Cy are in parallel with the diodes Dx and Dy, respectively and the conduction of diodes Dx and Dy becomes small. Therefore, modulation of capacitor Cin on the resonant tank is minimized so as to improve the lamp crest factor. Besides, since the voltage $v_a$ and current $i_{Lr}$ give a phase difference, the conduction angle of the line input current can be extended, as compared with the prior art circuits of FIGS. 1 and 6A. As a result, the circulating current in the resonant tank is reduced. The switches S1 and S2 actually conduct the resonant inductor current, so the switching current is also reduced, as compared with FIGS. 1 and 6A. However, the circulating current is still higher than that of FIG. 13. The DC bus voltage $V_{dc}$ at the start-up mode is also little higher than that of FIGS. 13 and 17. So, it is suitable for a lamp instant start application. This circuit can be produced less expensively than the circuits of FIGS. 13 and 17.

Figure 19A:
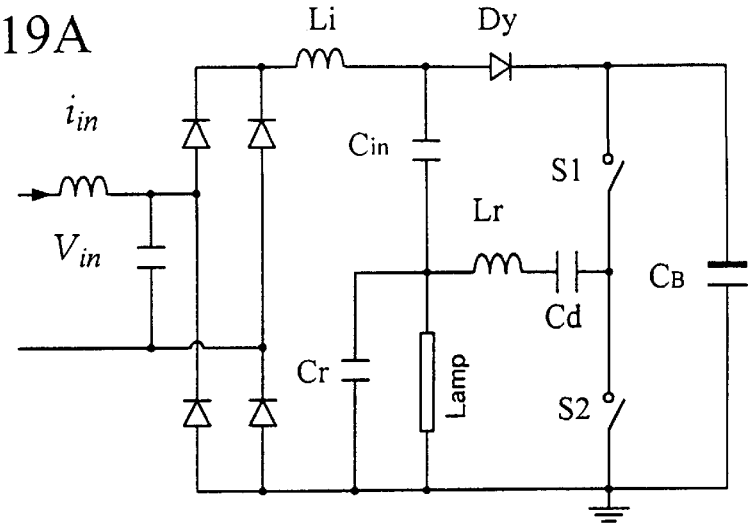
FIGS. 19A–19F are circuit diagrams of other embodiments of the present invention.

FIG. 19A illustrates another embodiment of the invention. The input inductor Li serves to achieve continuous line input current. As a result, the circulating current can also be minimized so that the voltage stress across the smoothing capacitor $C_B$ is reduced, compared to the prior art in U.S. Pat. No. 5,274,540. Capacitor $C_{in}$ is used to achieve power factor correction and low line input current distortion. This embodiment can be achieved by removing four components, these are capacitors $C_1$, $C_x$ and $C_y$ and diode D, thereby reducing the component count. However, the negative effect is that the DC bus voltage stress across the bulk capacitor may be slightly higher than that of the embodiment of FIG. 13.

Figure 19B:
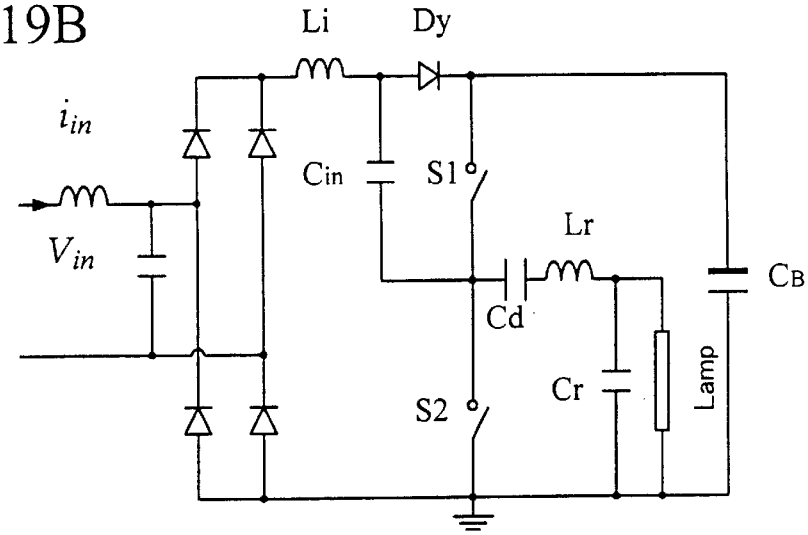

FIG. 19B illustrates yet another embodiment of the invention. The function of inductor $L_i$ the same as that of the other embodiments. Since the line input current is continuous, the charge capacitor $C_{in}$ could be small. Because of the smaller capacitor $C_{in}$, the lower the DC bus voltage. Additionally, small capacitor $C_{in}$ requires small resonant current in the resonant tank to discharge capacitor $C_{in}$. Therefore, the circulating current and switching current stress could be smaller. These advantages are similar to the other invented circuits. The negative effect is that there is dead time required between two switches, and it may not be suitable for dimming applications.

Figure 19C:
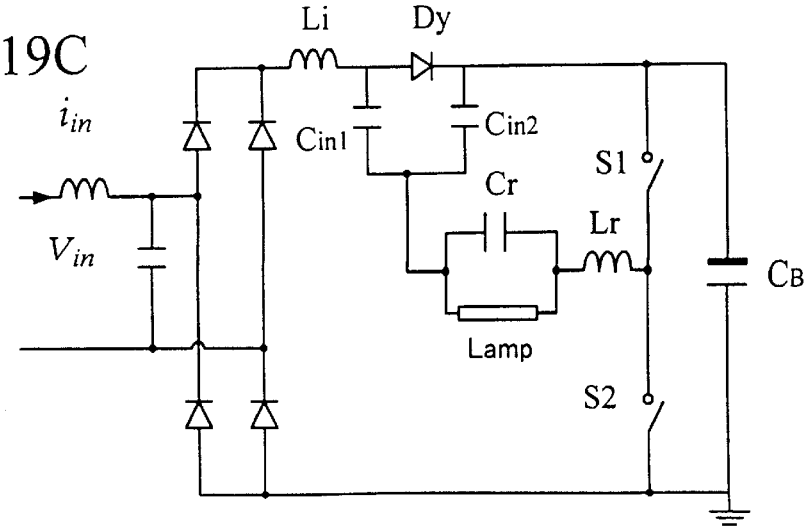

FIG. 19C is another embodiment of the invention, where inductor $L_i$ is used to achieve continuous line input current, incorporated with capacitor $C_{in1}$ and $C_{in2}$ to achieve low line input current harmonics and high power factor. This circuit also has low circulating current in the resonant tank even at the lamp start-up mode. As a result, the DC bus voltage at lamp start-up is reduced to some extent. However, it would be higher than the voltage at start-up of the circuit in FIG. 13.

Figure 19D:
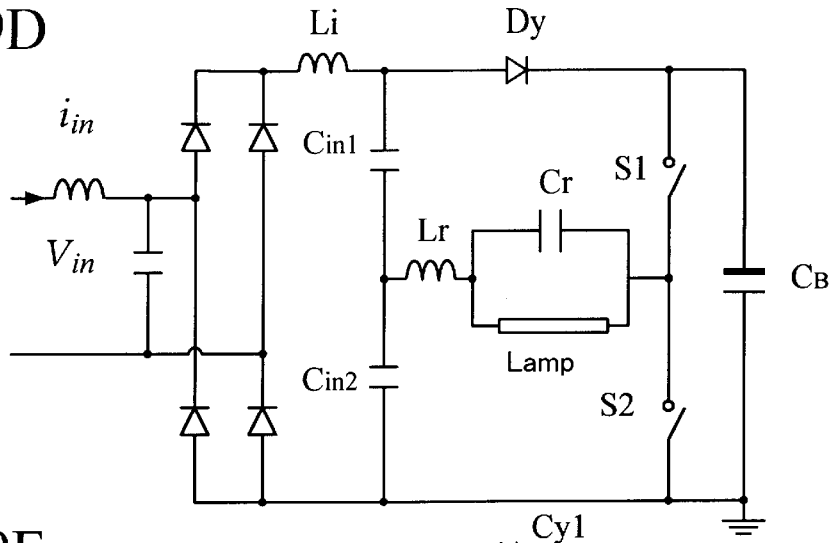

FIG. 19D is equivalent to the circuit in FIG. 19C. Capacitor $C_{in2}$ in circuit of FIG. 19C can be shifted through the bulk capacitor $C_B$ in high frequency sense. So, the performance is the same as that of circuit in FIG. 19C.

Figure 19E:
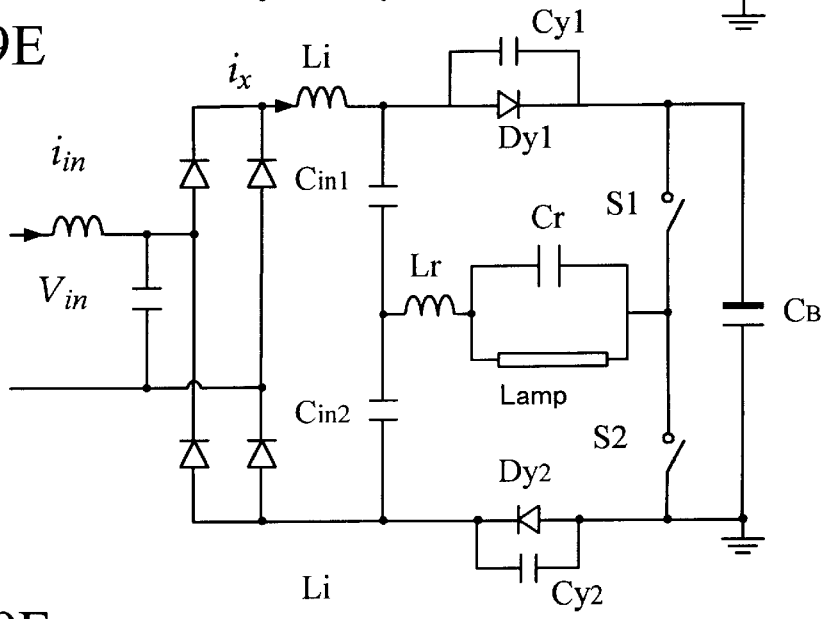

FIG. 19E illustrates a further embodiment of the invention. This circuit actually can be obtained by shifting the load connection from the circuit in FIG. 13. Inductor $L_i$ is also used to achieve continuous line input so that the resonant current can be designed to be very small even at the lamp start-up mode to reduce the bulk capacitor voltage at start-up mode. Two capacitors $C_{y1}$ and $C_{y2}$ are used to delay turn-on time of their two parallel diodes to further suppress the DC bus voltage stress during the lamp start-up mode. Therefore, this circuit has similar performance of the circuit in FIG. 13.

Figure 19F:
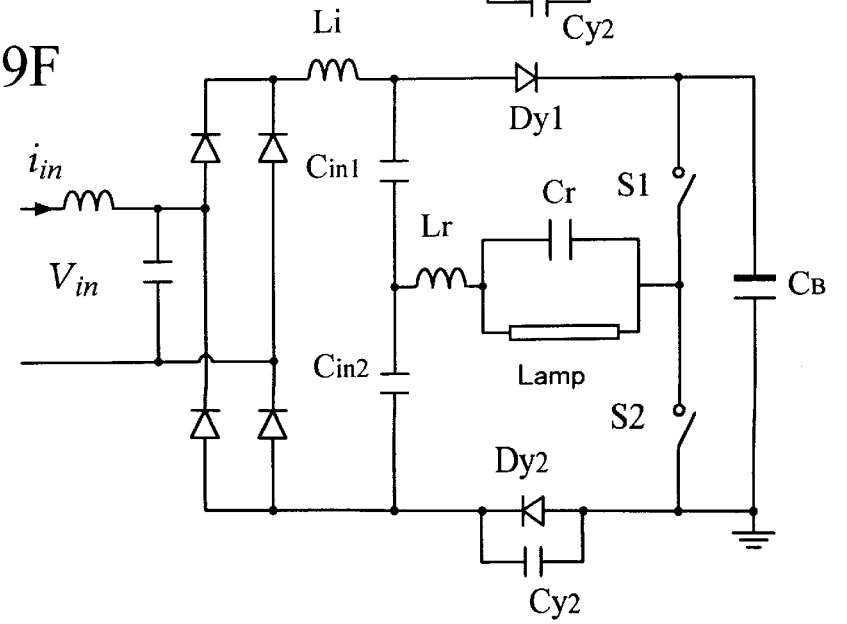

FIG. 19F illustrates another embodiment of the current invention. In this circuit, one capacitor $C_{y1}$ is removed from the circuit in FIG. 19E. One capacitor $C_{y2}$ is used to delay the turn-on time of the diode $D_{y2}$. Actually there is capacitor loop in circuit in FIG. 19E, which is composed of $C_{in1}$, $C_{in2}$, $C_B$ and $C_{y1}$. Therefore, $C_{y1}$ could be equivalent of the combination of $C_{in1}$, $C_{in2}$, and $C_B$. So, this circuit also has low DC bus voltage at lamp start-up, low circulating current, but is higher than that of the circuit in FIG. 19E.

The above-discussed embodiments of the invention are illustrative in nature, and should not be interpreted as being limiting in any way. Various modifications, improvements, and combinations of the disclosed invention would be apparent to those skilled in the art, and remain within the spirit and scope of the invention. The scope of the invention is defined by the appended claims.

We claim:

1. A gas discharge lamp driving circuit, comprising:

a blocking filter for filtering an AC voltage signal;

a rectifier for rectifying the AC voltage signal from the blocking filter into a DC voltage;

a smoothing capacitor connected to an output of the rectifier, for smoothing the DC voltage;

an inverter including at least two switching elements therein, said inverter connected to said smoothing capacitor for converting the DC voltage into a high frequency AC voltage;

a control circuit connected to said inverter for controlling said at least two switching elements to turn on and off in a feedback manner based upon at least one of input voltage to the inverter and output voltage from the inverter;

a resonant tank connected to the inverter, said resonant tank comprising a resonant capacitor (Cr) and a resonant inductor (Lr);

a discharge lamp connected to the resonant tank, in parallel with said resonant capacitor (Cr) said discharge lamp having high frequency electric power provided thereto from said inverter through said resonant tank;

a modulation capacitor (Cin) connected to said resonant tank, said modulation capacitor for reducing a distortion of an input current to said resonant circuit;

at least two input power diodes (Dx and Dy) connected between the rectifier and the smoothing capacitor;

a stress capacitor (Cx, Cy) connected in parallel with each input power diode of said at least two input power diodes;

wherein a discharge time of the stress capacitors delays a turn-on time of the input power diodes, thereby reducing input power at a start-up mode.

2. A gas discharge lamp driving circuit as recited in claim 1, further comprising an input inductor (Li) connected between one of the input power diodes and the rectifier, said input inductor reducing a circulating current in the resonant tank, thereby reducing input power at start-up.

3. A gas discharge lamp driving circuit as recited in claim 1, wherein said control circuit comprises:

a detector for detecting at least one of the input voltage to the inverter and a load output from the inverter, with an output of the detector being connected to a feedback circuit which modulates a control signal to achieve a constant lamp power, and to reduce low frequency ripple of lamp current, said control circuit further comprising an error amplifier for amplifying an error between a detected lamp current and a reference voltage $V_{ref}$, said error amplifier being provided with voltage V1 from the detector and said reference voltage $V_{ref}$, and outputting voltage V2, said control circuit further comprising a switching device connected to an output of the error amplifier, said switching device for switching an input to a driver device connected to said at least two switching elements, for providing modulated control signals to the at least two switching elements.

4. A gas discharge lamp driving circuit as recited in claim 1, wherein said modulation capacitor (Cin) is configured to function as part of the resonant tank when one of the at least two input power diodes (Dx and Dy) is turned on.

5. A gas discharge lamp driving circuit as recited in claim 1, further comprising a suppression capacitor (C1) connected across the output of the rectifier, for suppressing line input current harmonics and ripple.

6. A gas discharge lamp driving circuit as recited in claim 3, wherein said detector detects at least one of lamp current, lamp voltage, lamp power, and a resonant current of the resonant tank as a value representing the load output from the inverter.

7. A gas discharge driving circuit as recited in claim 3, wherein said detector detects at least one of an input current to the rectifier, an input voltage to the rectifier, and an output voltage from the rectifier as the input voltage to the inverter.

8. A gas discharge lamp driving circuit, comprising:

a blocking filter for filtering an AC voltage signal;

a rectifier for rectifying the AC voltage signal from the blocking filter into a DC voltage;

a smoothing capacitor connected to an output of the rectifier, for smoothing the DC voltage;

an inverter including at least two switching elements therein, said inverter connected to an output of the rectifier for converting the DC voltage into a high frequency AC voltage;

a control circuit connected to said inverter for controlling said at least two switching elements to turn on and off in a feedback manner based upon at least one of input voltage to the inverter and output voltage from the inverter;

a resonant tank connected to the inverter, said resonant tank comprising a resonant capacitor (Cr) and a resonant inductor (Lr);

a discharge lamp connected to the resonant tank, in parallel with resonant capacitor (Cr), said discharge lamp having high frequency electric power provided thereto from said inverter through said resonant tank;

a modulation capacitor (Cin) connected to said resonant tank, said modulation capacitor for reducing a distortion of an input current to said resonant tank;

an input power diode (Dy) connected between the inductor and the inverter;

wherein an input inductor (Li) is configured to achieve continuous line input current, thereby reducing circulating current within the circuit such that voltage stress across said smoothing capacitor (Cb) is reduced, and wherein said modulation capacitor (Cin) achieves power factor correction and low line input current distortion, thereby reducing input power at start-up mode.

9. A gas discharge lamp driving circuit, comprising:

a blocking filter for filtering an AC voltage signal;

a rectifier for rectifying the AC voltage signal from the blocking filter into a DC voltage;

a smoothing capacitor connected to an output of the rectifier, for smoothing the DC voltage;

an inverter including at least two switching elements therein, said inverter connected to said smoothing capacitor for converting the DC voltage into a high frequency AC voltage;

a control circuit connected to said inverter for controlling said at least two switching elements to turn on and off in a feedback manner based upon at least one of input voltage to the inverter and output voltage from the inverter;

a resonant tank connected to the inverter, said resonant tank comprising a resonant capacitor (Cr) and a resonant inductor (Lr);

a discharge lamp connected to the resonant tank, in parallel with said resonant capacitor (Cr), said discharge lamp having high frequency electric power provided thereto from said inverter through said resonant tank;

a modulation capacitor (Cin) connected to said resonant tank, said modulation capacitor for reducing a distortion of an input current to said resonant circuit;

at least one input power diode (Dy) connected between the rectifier and the smoothing capacitor;

at least one stress capacitor connected in parallel with said at least one input power diode;

wherein a discharge time of the at least one stress capacitor delays a turn-on time of the at least one input power diode, thereby reducing input power at a start-up mode.

* * * * *